US005689281A

United States Patent [19]

Nomura

[11] Patent Number: 5,689,281

[45] Date of Patent: Nov. 18, 1997

[54] LIQUID CRYSTAL DISPLAY APPARATUS

[75] Inventor: Takao Nomura, Tenri, Japan

[73] Assignee: Sharp Kabushiki Kaisha, Osaka, Japan

[21] Appl. No.: 456,868

[22] Filed: Jun. 1, 1995

[30] Foreign Application Priority Data

Jun. 28, 1994 [JP] Japan ..... 6-146486

[51] Int. Cl.[6] ..... G09G 3/36

[52] U.S. Cl. ..... 345/94; 345/208

[58] Field of Search ..... 345/94, 95, 96, 345/97, 87, 208, 91, 209, 210; 348/792, 790, 793; 359/54, 55, 60

[56] References Cited

U.S. PATENT DOCUMENTS

| | | | |
|---|---|---|---|
| 4,730,140 | 3/1988 | Masubuchi | 345/91 |
| 5,367,391 | 11/1994 | Johno et al. | 345/96 |
| 5,526,015 | 6/1996 | Tsuboyama et al. | 345/94 |

FOREIGN PATENT DOCUMENTS

| | | |
|---|---|---|
| 5-323385 | 12/1993 | Japan . |
| 5-341264 | 12/1993 | Japan . |
| 6-214216 | 8/1994 | Japan . |

*Primary Examiner*—Dennis-Doon Chow
*Attorney, Agent, or Firm*—Nixon & Vanderhye P.C.

[57] ABSTRACT

A liquid crystal display apparatus of the invention includes: a pair of substrates and a liquid crystal layer sandwiched therebetween; a plurality of scanning signal formed on one substrate; a plurality of data signal lines arranged perpendicular to the scanning signal lines and formed on the other substrate; pixel electrodes respectively at crossing portions in which the scanning signal lines cross the data signal lines; and nonlinear resistive two-terminal devices respectively provided between the pixel electrodes and the scanning signal lines. Scanning signals each including a selection period and a non-selection period are applied to the scanning signal lines, and data signals are applied to the data signal lines. While these signals are applied to the scanning signal lines and the data signal lines, liquid crystal application signals are applied to the liquid crystal layer via the two-terminal devices. Each liquid crystal application signal has a first voltage in a writing period as a first half of the selection period and a second voltage in a regulating period as a latter half of the selection period. The first voltage is determined in accordance with video data. The second voltage is a voltage at which part of the electric charge, which is charged into the liquid crystal layer in the writing period, is released.

4 Claims, 11 Drawing Sheets

Scanning signal A
11
15
13
16
18
17

Data signal B1
12
14

Signal C1 applied to liquid crystal
19
20

Scanning signal A
11
15
13
16
18
17

Data signal B2
12
14

19
Signal C2 applied to liquid crystal
20

Fig. 11 (Prior Art)
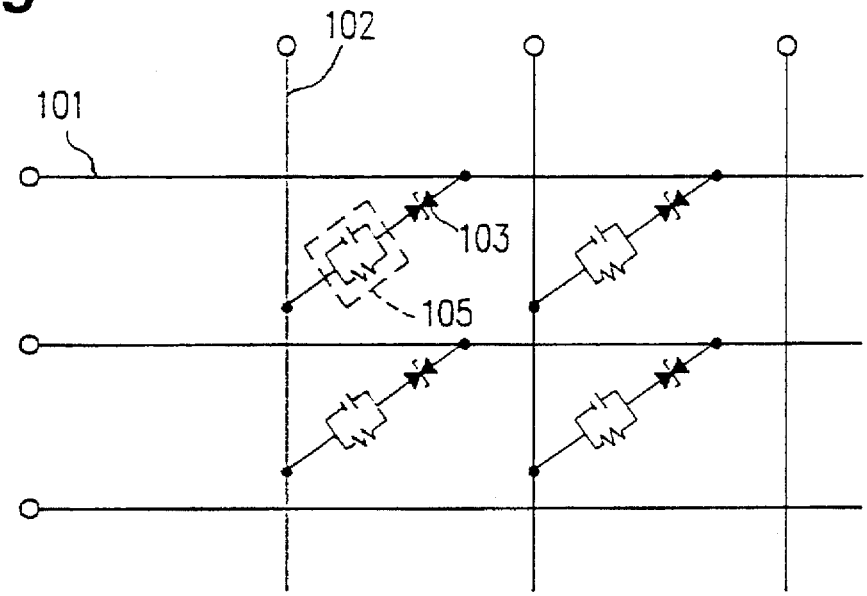
Fig. 12A (Prior Art)
Fig. 12B
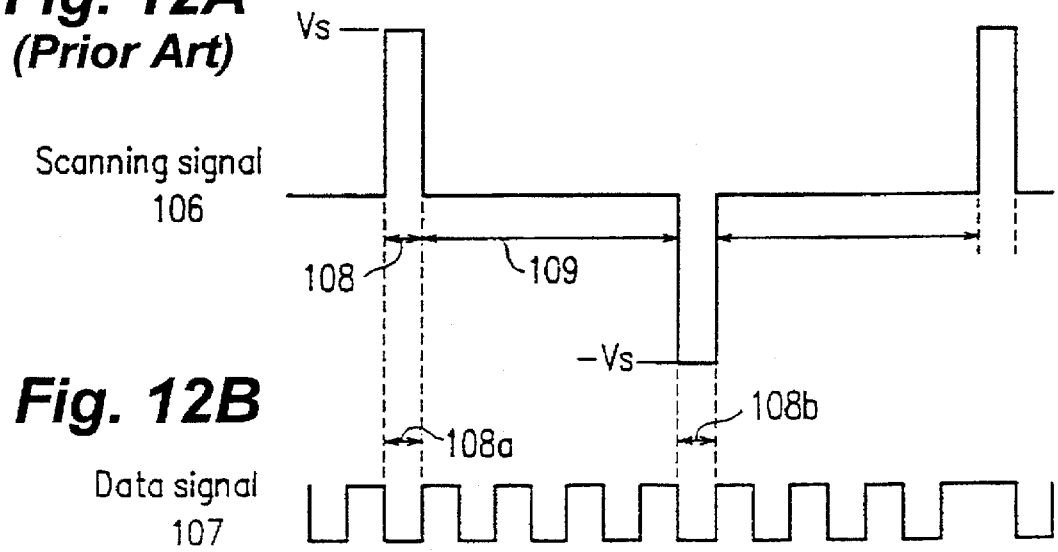

LIQUID CRYSTAL DISPLAY APPARATUS

BACKGROUND OF THE INVENTION

1. Field of the Invention

The present invention relates to a liquid crystal display apparatus using a nonlinear resistive two-terminal device.

2. Description of the Related Art

FIGS. 10A and 10B are plan views showing a pair of substrates which constitute a general type of liquid crystal display apparatus using a nonlinear resistive two-terminal device as a switching device. As shown in FIG. 10B, the substrate 100*b*, which is called as a counter substrate, includes an insulating substrate 1*b* and a plurality of data signal lines 102 which are formed on the insulating substrate 1*b*. The data signal lines are parallel to each other.

As shown in FIG. 10A, the substrate 100*a* includes an insulating substrate 1*a*. On the insulating substrate 1*a*, a plurality of scanning signal lines 101 which are parallel to each other are formed. The scanning signal lines 101 are perpendicular to the data signal lines 102. At each of the portions of insulating substrate 1*a* at which the scanning signal lines 101 cross the data signal lines 102, a pixel electrode 104 is formed. At each of the portions, a nonlinear resistive two-terminal device 103 for connecting a pixel electrode 104 to a corresponding scanning signal line 101 is formed. Between the attached substrates 100*a* and 100*b*, a liquid crystal layer (not shown) is sandwiched.

FIG. 11 shows an equivalent circuit of a general type of liquid crystal display apparatus using a nonlinear resistive two-terminal device. Herein, a liquid crystal layer 105 is represented by a parallel circuit of a resistor and a capacitor.

Next, the operation of this liquid crystal display apparatus is described. A scanning signal 106 (FIG. 12A) is applied to the scanning signal line 101, and a data signal 107 (FIG. 12B) is applied to the data signal line 102. Accordingly, a potential difference between the scanning signal line 101 and the data signal line 102 is applied to the nonlinear resistive two-terminal device 103 and the liquid crystal layer 105 which are connected in series. The scanning signal 106 includes a selection period 108 and a non selection period 109. In the selection period 108, the scanning signal 106 has selection potential ($V_s$) for setting the nonlinear resistive two-terminal device 103 into a conductive state. In the non selection period 109, the scanning signal 106 has a non selection potential for setting the nonlinear resistive two-terminal device 103 into a nonconductive state. Potential in a selection period is determined so that the polarity thereof is inverted from that of the potential of the selection period in one previous cycle. Accordingly, the liquid crystal is driven in an alternating current (AC) manner.

The data signal 107 ($V_d$) has one of two potentials for allowing the magnitude of a current flowing through the nonlinear resistive two-terminal device 103 to increase or decrease in the selection period 108 of the scanning signal, or the data signal 107 ($V_d$) has an arbitrary intermediate potential between the abovementioned two potentials.

Hereinafter, it is assumed that the display is black during a period in which a high voltage is applied to the liquid crystal layer, and the display is white during a period in which a low voltage is applied to the liquid crystal layer. In FIG. 12A, a selection period 108*a* is a period in which the magnitude of a current flowing through the nonlinear resistive two-terminal device 103 is increased so as to perform a black display. A selection period 108*b* is a period in which the magnitude of the current is decreased so as to perform a white display. In this way, an appropriate voltage is applied to the liquid crystal layer 105 from the nonlinear resistive two-terminal device 103 which is set in the conductive state during the selection period 108. The applied voltage is held in the liquid crystal layer 105 during the non selection period 109. The above-described voltage application and holding operation is repeated, so as to perform a liquid crystal display.

However, a conventional liquid crystal display apparatus using a nonlinear resistive two-terminal device involves the following problems.

A large number of nonlinear resistive two-terminal devices, which are formed over an entire display portion of the substrate 101*a* as shown in FIG. 10A, do not have identical characteristics. That is, the characteristics are inevitably varied between the respective nonlinear resistive two-terminal devices. In the case where nonlinear resistive two-terminal devices are fabricated by repeatedly performing the formation of thin films and the photolithography process for the thin films, it is impossible to form a thin film so as to have a uniform thickness over an entire surface of the substrate 101*a*, end some deviation cannot be avoided due to a variation in irradiation in an exposure step, or the like, even by the photolithography process. In the cases where the nonlinear resistive two-terminal devices are fabricated by any other methods, it is impossible to avoid the occurrence of variation in device characteristics.

In the case where the characteristics of the nonlinear resistive two-terminal devices are different from each other, there occurs a difference between voltages applied to the liquid crystal layer even when the same scanning signal is applied, as indicated by signal waveforms 29 and 30 in FIG. 4B. The signal waveforms 29 and 30 indicate voltages applied to the liquid crystal layer in a display picture element portion including a nonlinear resistive two-terminal device having a larger current value and a smaller current value, respectively, in the case where a fixed voltage is applied. As seen from the signal waveforms 29 and 30, there occurs a variation in display.

SUMMARY OF THE INVENTION

The liquid crystal display apparatus of this invention includes: a pair of substrates and a liquid crystal layer sandwiched therebetween; a plurality of scanning signal lines arranged in parallel to each other, the scanning signal lines being formed on one of the pair of substrates; a plurality of data signal lines arranged in parallel to each other and perpendicular to the scanning signal lines, the data signal lines being formed on the other of the pair of substrates; pixel electrodes respectively formed on the one of the pair of substrates at crossing portions in which the scanning signal lines cross the data signal lines, the pixel electrodes, the data signal lines opposed to the pixel electrodes and portions of the liquid crystal layer between the pixel electrodes and the data signal lines constituting picture elements; and nonlinear resistive two-terminal devices respectively provided between the pixel electrodes and the scanning signal lines. Scanning signals each including a selection period and a non-selection period are applied to the scanning signal lines, data signals are applied to the data signal lines, and liquid crystal application signals are applied across series circuits including the portions of the liquid crystal layer and the nonlinear resistive two-terminal devices while the scanning signals are applied to the scanning signal lines and the data signals are applied to the data signal lines. Each of the liquid crystal application signals has a first voltage in a writing period as a first half of the selection period and a second voltage in a regulating period as a latter half of the selection period. The first voltage is a voltage determined in accordance with video data, and electric charge corresponding to the first voltage of the each of the liquid crystal application signals is charged into corresponding one of the portions of the liquid crystal layer in the writing period. The second voltage is a voltage at which part of the electric charge in the corresponding one of the portions of the liquid crystal layer is released.

In one embodiment of the invention, each of the liquid crystal application signals has a third voltage in the non-selection period immediately after the selection period, each of the scanning signals has a potential with the same polarity as that of the third voltage in the writing period, and a potential with an opposite polarity to that of the third voltage in the regulating period, and each of the data signals has a fixed voltage determined in accordance with the video data over a whole of the selection period.

In another embodiment of the invention, each of the liquid crystal application signals has a third voltage in the non-selection period immediately after the selection period, each of the scanning signals has a potential with the same polarity as that of the third voltage in the writing period, and a potential with an opposite polarity to that of the third voltage in the regulating period, and each of the data signals has a voltage determined in accordance with the video data in the writing period, and has a fixed voltage irrespective of the video data in the regulating period.

In still another embodiment of the invention, in the each of the scanning signals, the writing period is longer than the regulating period.

Thus, the invention described herein makes possible the advantage of providing a liquid crystal display apparatus in which a variation in voltage applied to liquid crystal due to difference in characteristics of nonlinear resistive two-terminal devices, whereby a variation in display can be eliminated.

This and other advantages of the present invention will become apparent to those skilled in the art upon reading and understanding the following detailed description with reference to the accompanying figures.

BRIEF DESCRIPTION OF THE DRAWINGS

FIG. 1*a* is a cross-sectional view and FIG. 1B is a plan view showing a counter substrate on which the nonlinear resistive two-terminal display apparatus is formed.

FIG. 3A is a cross-sectional view and FIG. 3B is a plan view showing a counter substrate on which the nonlinear resistive two-terminal display apparatus is formed.

FIG. 11 is an equivalent circuit diagram of a conventional general type of liquid crystal display apparatus using a nonlinear resistive two-terminal device.

FIGS. 12A and 12B are signal waveform charts showing a scanning signal waveform and a data signal waveform in the case where a general driving method is used in a conventional liquid crystal display apparatus.

DESCRIPTION OF THE PREFERRED EMBODIMENTS

Hereinafter, examples of the invention will be described with reference to the accompanying drawings.

(EXAMPLE 1)

Figure 1A:
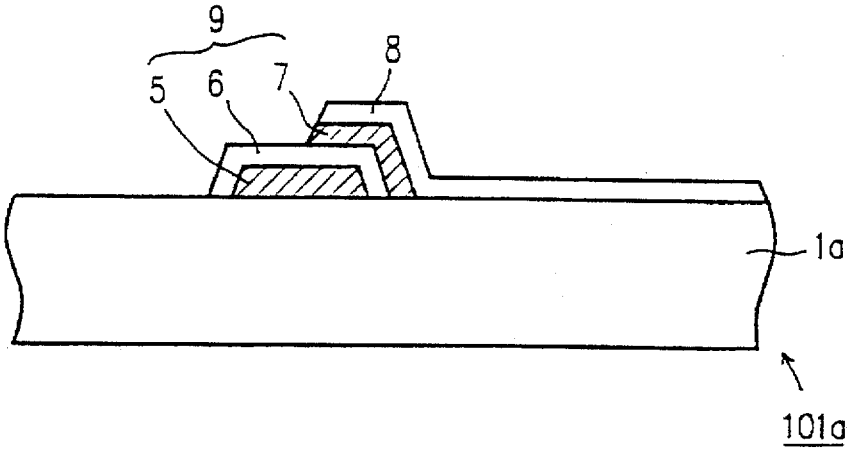
FIGS. 1A and 1B are views for illustrating a liquid crystal display apparatus using a nonlinear resistive two-terminal device in a first example according to the invention.
Figure 1B:
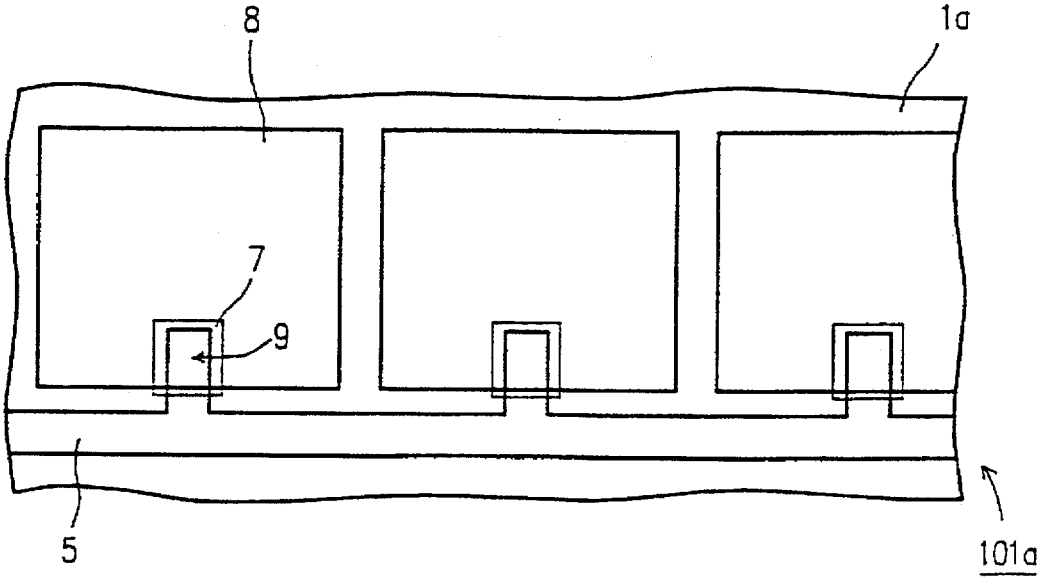

FIGS. 1A and 1B are a cross-sectional view and a plan view, respectively, showing one of a pair of substrates which constitute a liquid crystal display apparatus in a first example according to the invention. The substrate 101*a* shown in FIG. 1B includes a plurality of nonlinear resistive two-terminal devices. In FIG. 1A, only one of the nonlinear resistive two-terminal devices is shown.

On a glass substrate 1*a*, a plurality of scanning signal lines 5 are formed. Along each scanning signal line 5, pixel electrodes 8 constituting picture elements are arranged. Between each of the pixel electrodes 8 and the scanning signal line 5, a nonlinear resistive two-terminal device 9 is provided.

Next, the fabrication method of the counter substrate is described.

On the glass substrate 1*a*, a thin Ta film is formed by sputtering. The thin Ta film is then patterned by photolithography so as to form a scanning signal lane 5. Next, a thin $Ta_2O_5$ film 6 is formed on the surface of the thin Ta film by anodization. A thin Ti film is then deposited on the thin $Ta_2O_5$ film 6 by sputtering. The thin Ti film is then patterned by photolithography so as to obtain a plurality of thin Ti films 7 which are arranged at regular intervals along the scanning signal line 5. The three-layer structure of the thin Ti film 7, the $Ta_2O_5$ film 6, and the thin Ta film (the scanning signal line 5) constitutes a nonlinear resistive two-terminal device 9.

A thin ITO (indium tin oxide) film is then formed by sputtering. The thin ITO film is patterned by photolithography, so as to form a pixel electrode 8 shown in FIG. 1B. Thus, the fabrication of the substrate 101*a* on which the nonlinear resistive two-terminal devices are formed is completed.

Figure 9A:
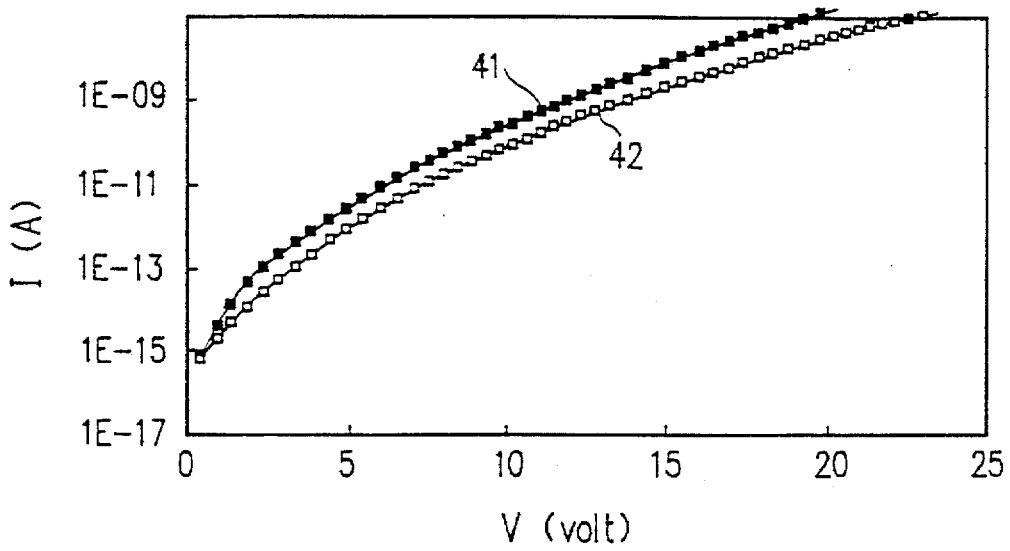
FIGS. 9A and 9B are diagrams showing I–V characteristics of nonlinear resistive two-terminal devices used in the liquid crystal display apparatus of the first and second examples according to the invention.

The I–V characteristics are different between respective nonlinear resistive two-terminal devices, as shown in FIG. 9A, because the device areas are not equal to each other due to deviation in the photolithography processes for the thin Ta film and the thin Ti film and the thickness of the thin $Ta_2O_5$ film is not uniform. In FIG. 9A, curve 41 indicates the I–V characteristic of a device in which the device area is large and the thickness of the thin $Ta_2O_5$ film is small. Curve 42 indicates the I–V characteristic of a device in which the device area is small and the thickness of the thin $Ta_2O_5$ film is large.

Figure 2:
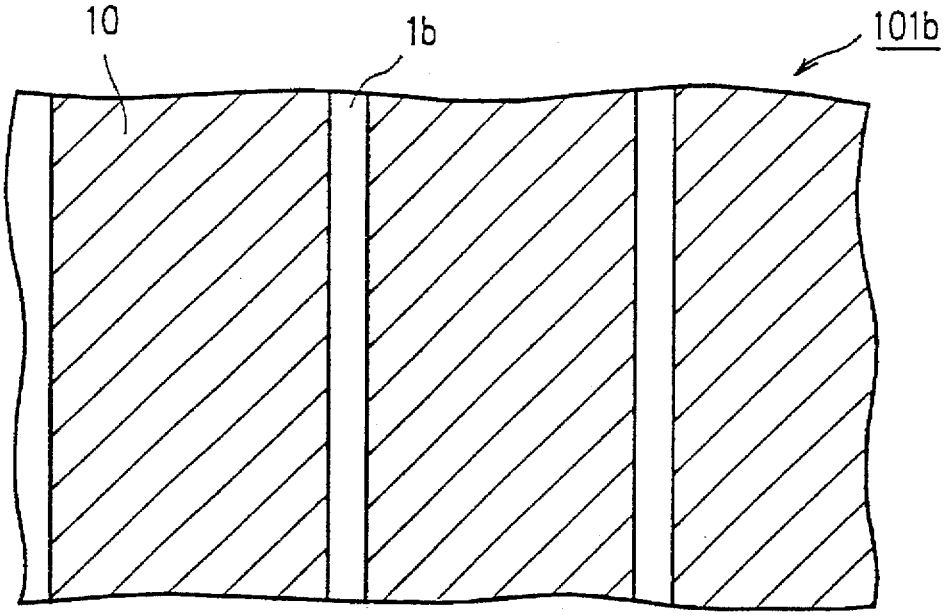
FIG. 2 is a plan view showing a counter substrate on which the nonlinear resistive two-terminal display apparatus is not formed of the liquid crystal display apparatus in the first example according to the invention.

A counter substrate 101*b* on which nonlinear resistive two-terminal devices are not formed is fabricated in the following manner. First, a thin ITO film is formed by sputtering on a glass substrate 1*b*. The thin ITO film is patterned by photolithography so as to have a stripe pattern as shown in FIG. 2. Each of the strip-like thin ITO films serves as a data signal line 10.

The substrates 101*a* and 101*b* are attached to each other so that the scanning signal lines 5 are perpendicular to the data signal lines 10 and then fixed using a sealing resin. A gap between the substrates 101*a* and 101*b* is filled with twisted nematic type liquid crystal. Polarization plates are then attached to respective surfaces of the substrates 101*a* and 101*b*. Thus, the formation of a liquid crystal panel is completed.

Then, terminals of the scanning signal lines 5 and terminals of the data signal lines 10 which are led to the outside of the liquid crystal panel are connected to a scanning driver (not shown) and a data driver (not shown). The scanning driver applies scanning signals to the scanning signal lines 5 while the data driver applies the data signals to the data signal lines 10. In this way, the formation of a liquid crystal display apparatus is completed.

Next, the functions and effects will be described.

Figures 7A, 7B, 7C:
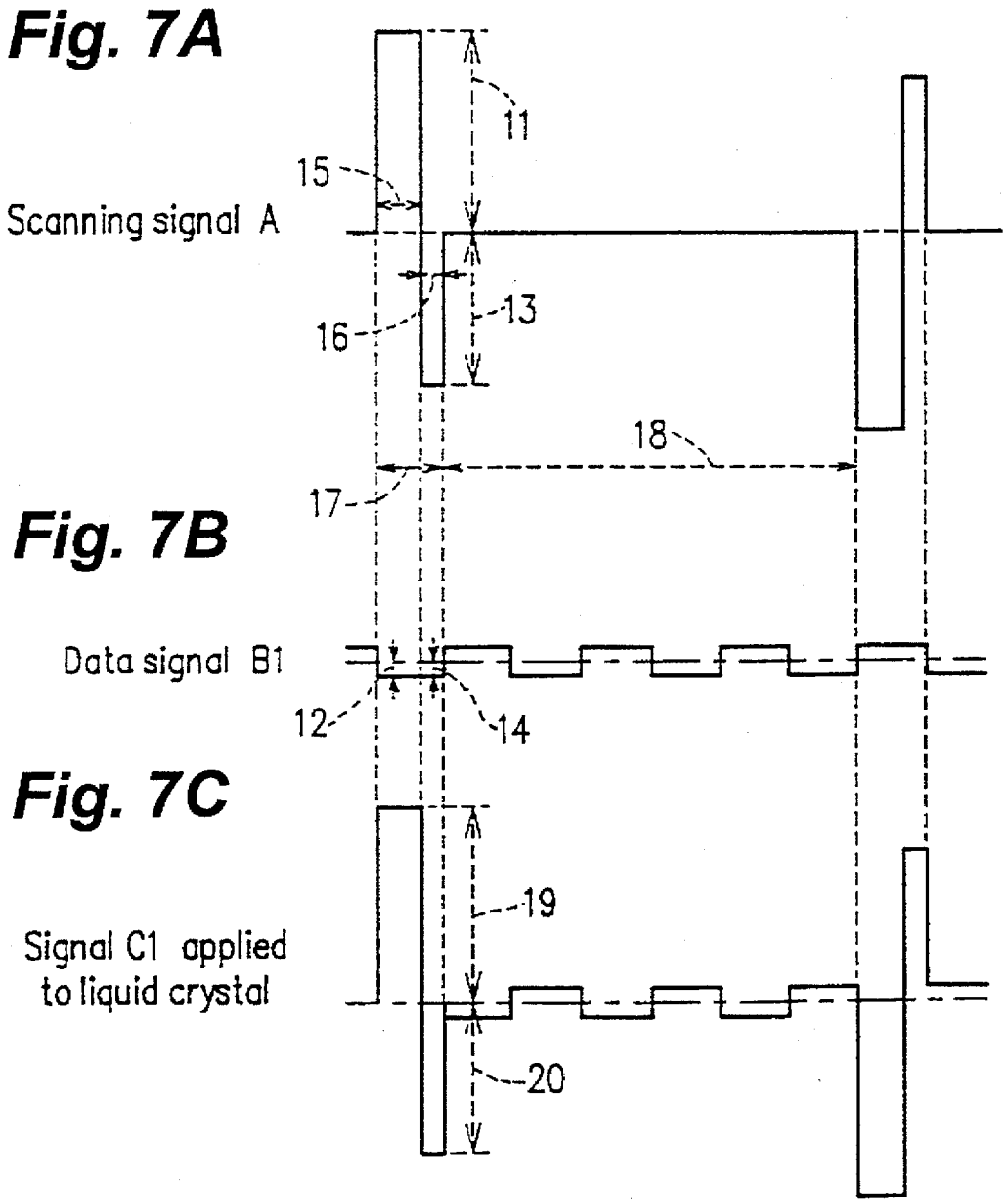
FIGS. 7A to 7C are diagrams respectively showing an example of waveforms of a scanning signal, a data signal, and a voltage applied to liquid crystal using the scanning and data signals in the liquid crystal display apparatus in the first and second examples according to the invention.
Figures 8A, 8B, 8C:
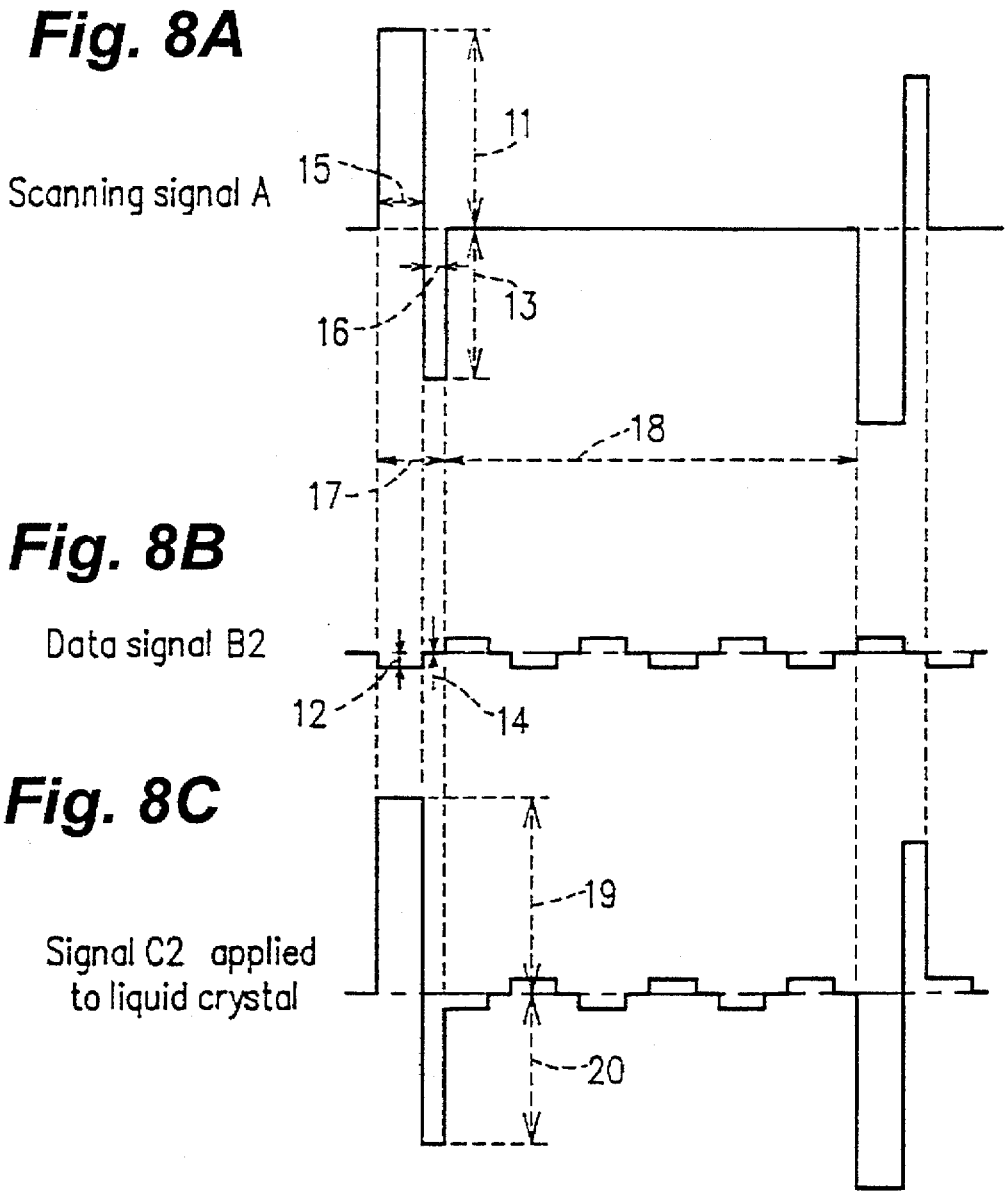
FIGS. 8A to 8C are diagrams respectively showing another example of waveforms of a scanning signal, a data signal, and a voltage applied to liquid crystal using the scanning and data signals in the liquid crystal display apparatus in the first and second examples according to the invention.

In the liquid crystal display apparatus, it is assumed that signals on the scanning signal line and the data signal line have driving waveforms as shown in FIGS. 7A to 7C or 8A to 8C. FIGS. 7A and 8A both show the waveform of the scanning signal A. FIGS. 7B and 8B show the waveforms of the data signals B1 and B2, respectively. FIGS. 7C and 8C respectively show signals C1 and C2, which are applied across a series circuit of the liquid crystal layer and the nonlinear resistive two-terminal device by applying the scanning signal A and the data signal B1 or B2. A selection period 17 of a scanning signal includes a first-half writing period 15 in which a voltage determined in accordance with video data is applied to the pixel electrodes, and a latter-half regulating period 16 in which a voltage for releasing part of charge charged in the liquid crystal of the picture elements during the writing period is applied to the pixel electrodes. The selection period 17 of the scanning signal is followed by a non-selection period 18 of the scanning signal. In the writing period 15, the potential of the scanning signal becomes $V_{sk}$ (indicated by the reference numeral 11) and the potential of the data signal becomes $V_{dk}$ (indicated by the reference numeral 12). On the other hand, in the regulating period 16, the potential of the scanning signal becomes $V_{sc}$ (indicated by the reference numeral 13) and the potential of the data signal becomes $V_{dc}$ (indicated by the reference numeral 14). As shown in FIGS. 7C and 8C, the potentials indicated by the reference numerals 19 and 20 are applied across series circuit of the liquid crystal layer and the nonlinear resistive two-terminal device in the writing period and in the regulating period, respectively, due to the application of the scanning signal and the data signal.

Figure 4A:
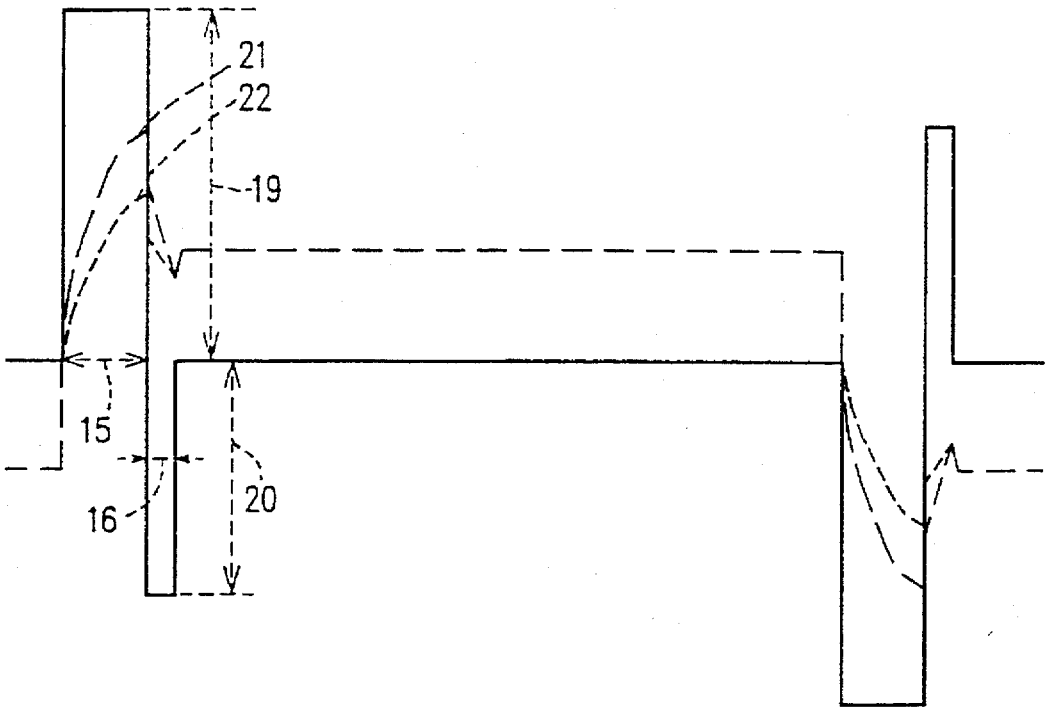
FIGS. 4A and 4B are diagrams showing driving waveforms for liquid crystal of this invention and for liquid crystal of the prior art, and voltages applied to the liquid crystal using the driving waveforms.
Figure 4B:
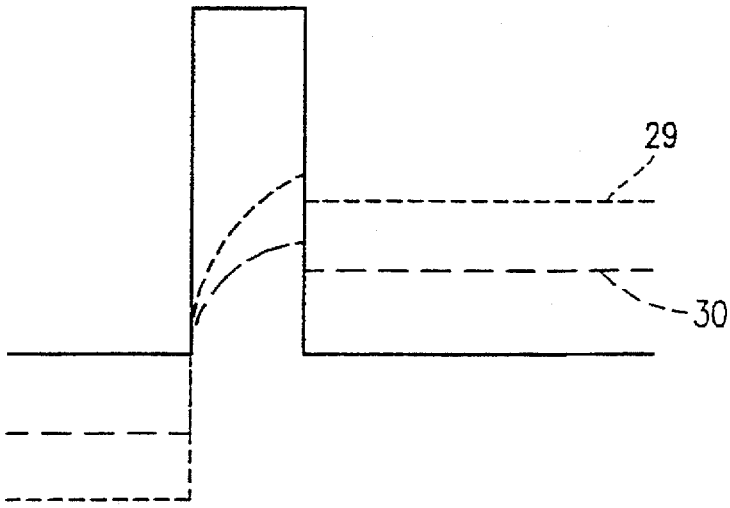

FIG. 4A shows a signal $V_{in}$ applied across the series circuit of the liquid crystal layer and the nonlinear resistive two-terminal device by the scanning signal A and the data signal B1 or B2. Note that the variation of a data signal in the non-selection period is omitted. In FIG. 4A, curves 21 and 22 represent voltages applied to liquid crystal in display picture elements including a nonlinear resistive two-terminal device having a larger current value and a nonlinear resistive two-terminal device having a smaller current value, respectively, when a fixed voltage is applied. As the current value of the nonlinear resistive two-terminal device becomes larger, the voltage applied to the liquid crystal in the writing period is increased, but the amount of charge lost in the regulating period is also increased. Accordingly, by optimizing the lengths of the writing period and the regulating period, and the voltages applied to the series circuit in the respective periods, it is possible to reduce the variation in voltage applied to liquid crystal due to the difference in characteristics between respective nonlinear resistive two-terminal devices, and hence the variation in display can be eliminated.

An exemplary method for determining lengths of the writing period and the regulating period, and a voltage applied to the series circuit is described below.

In FIG. 4A, the voltage 19 in the writing period 15 of the signal $V_{in}$ applied across the series circuit is represented by $V_{OP}$, the length thereof is represented by $t_1$. The voltage 20 in the regulating period 16 of the signal $V_{in}$ is represented by $V_R$, and the length thereof is represented by $t_2$. It is assumed that the length $t_1$ is larger than the length $t_2$. For example, the ratio of $t_1$ to $t_2$ is about 10:1.

The voltages $V_{OP}$ and $V_R$ in the case of the black display are represented by $V_{OPb}$ and $V_{Rb}$, respectively. The voltages $V_{op}$ and $V_R$ in the case of the white display are represented by $V_{OPw}$ and $V_{Rw}$, respectively.

Figure 5A:
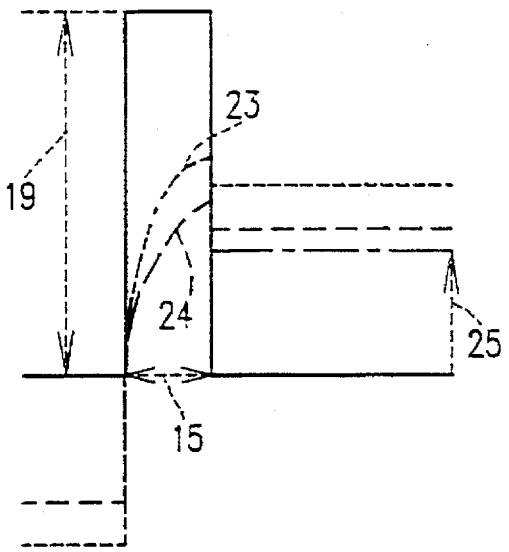
FIGS. 5A to 5C are diagrams showing a process for determining voltages of a scanning signal and a data signal for a black display.
Figure 5B:
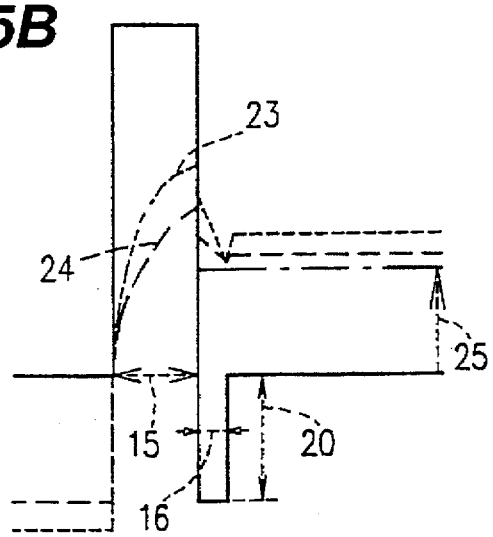
Figure 5C:
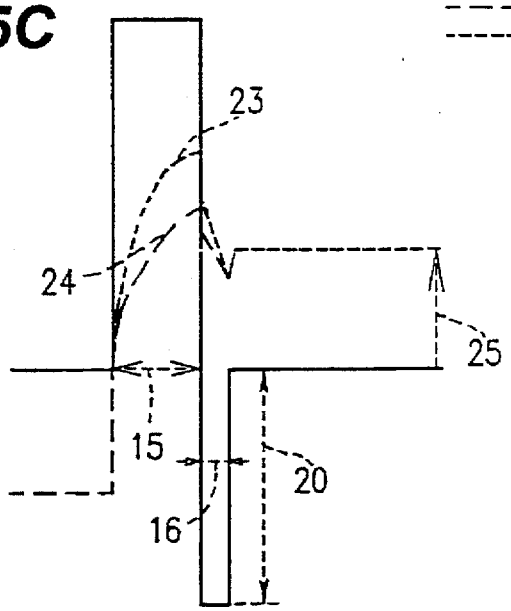

The setting process of the voltages $V_{OPb}$ and $V_{Rb}$ is described in accordance with FIGS. 5A to 5C. In FIGS. 5A to 5C, a curve 23 represents a voltage $V_{LCl(b)}$ applied to liquid crystal in the case where the current value of the nonlinear resistive two-terminal device is largest. Another curve 24 represents a voltage $V_{LCs(b)}$ applied to liquid crystal in the case where the current value of the nonlinear resistive two-terminal device is smallest.

(1) As shown in FIG. 5A, in the condition of $V_{Rb}=0$, the voltage $V_{OPb}$ is set so that the voltage $V_{LCs(b)}$ is larger than the voltage 25 applied to liquid crystal which is required for a black display.

(2) As shown in FIGS. 5B and 5C, the voltage $V_{Rb}$ is gradually increased, and $V_{Rb}$ is set to a value which satisfies the condition of $V_{LCl(b)}=V_{LCs(b)}$.

(3) If the voltage $V_{LCl(b)}$ is not equal to the voltage 25 applied to liquid crystal required for the black display, the setting process is started again from the setting of $V_{OPb}$ in step (1). For example, if $V_{LCl(b)}$ is smaller than the voltage 25 applied to liquid crystal required for the black display, $V_{OPb}$ is increased. If $V_{LCl(b)}$ is larger than the voltage 25 applied to liquid crystal required for the black display, $V_{OPb}$ is decreased. In this way, the voltage $V_{Rb}$ is set again.

Figure 6A:
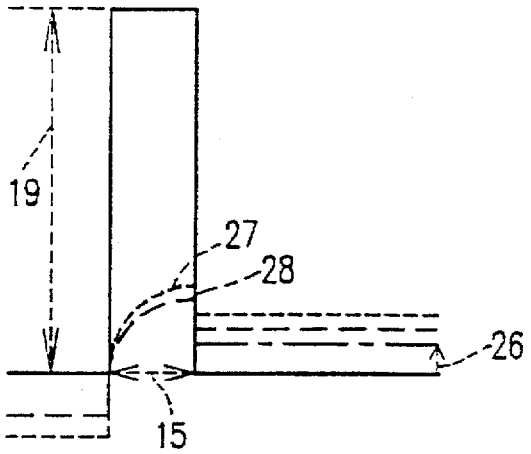
FIGS. 6A to 6C are diagrams showing a process for determining voltages of a scanning signal and a data signal for a white display.
Figure 6B:
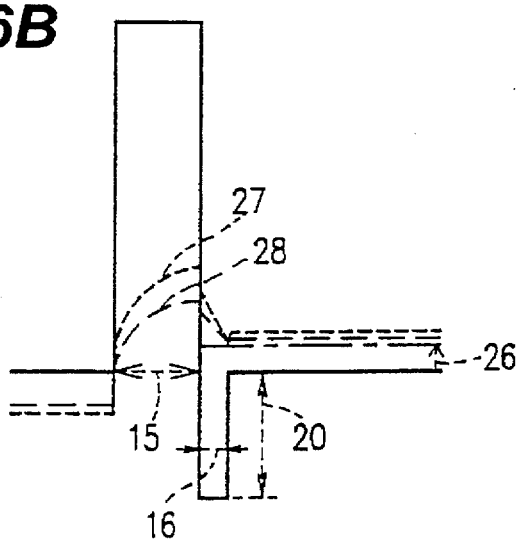
Figure 6C:
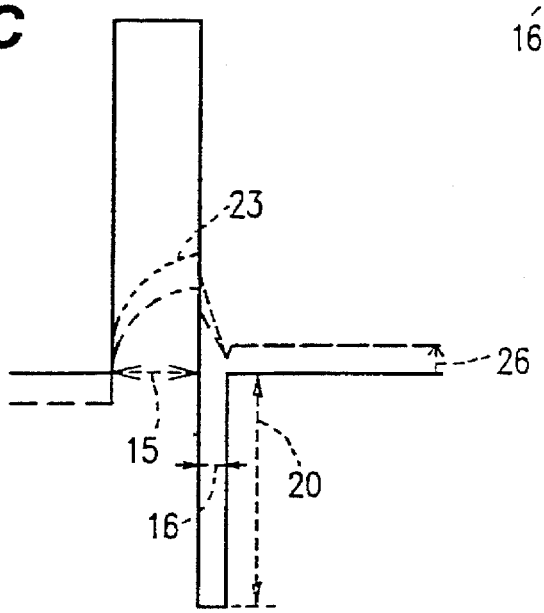

The voltages $V_{OPw}$ and $V_{Rw}$ are also determined by the following process as shown In FIGS. 6A to 6C. In FIGS. 6A to 6C, a curve 27 represents a voltage $V_{LCl(w)}$ applied to liquid crystal in the case where the current value of the nonlinear resistive two-terminal device is largest. Another curve 28 represents a voltage $V_{LCl(w)}$ applied to liquid crystal in the case where the current value of the nonlinear resistive two-terminal device is smallest.

(1)' As shown in FIG. 6A, in the condition of $V_{Rw}=0$, the voltage $V_{OPw}$ is set so that the voltage $V_{LCs(w)}$ is larger than the voltage 26 applied to liquid crystal which is required for a white display.

(2)' As shown in FIGS. 6B and 6C, the voltage $V_{Rw}$ is gradually increased, and $V_{Rw}$ is set to a value which satisfies the condition of $V_{LCl(w)}=V_{LCs(w)}$.

(3)' If the voltage $V_{LCl(w)}$ is not equal to the voltage 26 applied to liquid crystal required for the white display, the setting process is started again from the setting of $V_{OPw}$ in step (1)'. For example, if $V_{LCl(w)}$ is smaller than the voltage applied to liquid crystal required for the white display, $V_{OPw}$ is increased. If $V_{LCl(w)}$ is larger than the voltage applied to liquid crystal required for the white display, $V_{OPw}$ is decreased. In this way, the voltage $V_{Rw}$ is set again.

By using the thus determined voltages $V_{OPb}$, $V_{OPw}$, $V_{Rb}$, and $V_{Rw}$, the scanning signal potential $V_{sk}$ and the data signal potential $V_{dk}$ in the writing period, and the scanning signal potential $V_{sc}$ and the data signal potential $V_{dc}$ in the regulating period are obtained as follows:

$$V_{ak}=\pm(V_{OPb}+V_{OPw})/2$$

$$V_{sc}=\pm(V_{Rb}+V_{Rw})/2$$

$$V_{dk}=+(V_{OPb}-V_{OPw})/2 \text{ to } -(V_{OPb}-V_{OPw})/2$$

$$V_{dc}=+(V_{Rb}-V_{Rw})/2 \text{ to } -(V_{Rb}-V_{Rw})/2$$

On the basis of these equations, specific potentials can be obtained for each of the signal lines, If $V_{dk}=V_{dc}$, the actual data signal has a simple waveform B1 shown in FIG. 7B by using the results obtained from the above equations. If $V_{dk}$ is not equal to $V_{dc}$, the actual data signal is selected so as to have either the waveform B1 shown in FIG. 7B in a condition that $V_{dk}$ and $V_{dc}$ are set in the range of $+(V_{OPb}-V_{OPw})/2$ to $-(V_{OPb}-V_{OPw})/2$, or the waveform B2 shown in FIG. 8B in a condition that $V_{dk}$ has a value obtained from the above equation, and $V_{dc}$ is set to a constant value in the range of $+(V_{Rb}-V_{Rw})/2$ to $-(V_{Rb}-V_{Rw})/2$, whichever the variation in voltage applied to liquid crystal due to the characteristics of the nonlinear resistive two-terminal devices can be smaller.

In Japanese Laid-Open Patent. Publication No. 5-323385 and Japanese Laid-Open Patent Publication No. 5-341264, a method for driving liquid crystal using a scanning signal having a waveform including a pulse with the same polarity as that of a voltage applied to liquid crystal in a non-selection period immediately after the selection period, and a succeeding pulse with an opposite polarity to that of the voltage applied to liquid crystal. According to the technique described in these publications, the data signal in the inverse-polarity pulse period is changed to be a signal level in accordance with video data, so that an appropriate voltage is applied to a liquid crystal layer, whereby a residual image appearing in the liquid crystal display screen is reduced. The technique is completely different from the technique of this invention, because according to the technique of this invention, a data signal in the same-polarity pulse period is changed to be a signal level in accordance with a video signal so that an appropriate voltage is applied to a liquid crystal layer, whereby a variation in display in a liquid crystal display screen is reduced.

Next, the effects of Example 1 will be described by way of a specific example.

In accordance with the above-described method, and in the conditions of:

Selection period of scanning signal=69.4 μsec.,

Non selection period of scanning signal=16.6 msec., $t_1$=63 μsec., and $t_2$=6.4 μsec., the voltages $V_{OPb}$, $V_{OPw}$, $V_{Rb}$, and $V_{Rw}$ are obtained as follows:

$V_{OPb}$=26 V, and $V_{Rb}$=−20 V, where the voltage $V_{LC}$ applied to liquid crystal in the case where the potential of a data signal is constant is in the range of 3.3 to 3.5 V, and $V_{OPw}$=20 V, and $V_{Rw}$=−24 V, where the voltage $V_{LC}$ applied to liquid crystal in the case where the potential of a data signal is constant is in the range of 0.8 to 0.9 V.

From these specific values, the waveform A in FIG. 7A is adopted as the scanning signal, end the waveform B1 in FIG. 7B is adopted as the data signal, and the voltages $V_{sk}$, $V_{sc}$, $V_{dk}$, and $V_{dc}$ are set as follows:

$V_{sk}$=23.0 V, $V_{sc}$=−22.0 V, and $V_{dk}=V_{dc}$=3.0 V.

As a result, the voltages $V_{LC}$ applied to liquid crystal are obtained as follows, end the variation in display is not observed:

Voltage applied to liquid crystal (black display)

$V_{LC}$=3.2 to 3.4 V, and voltage applied to liquid crystal (white display)

$V_{LC}$=0.7 to 0.8 V.

In this case, the potential of a data signal is varied in a pulse like manner, so that the voltage applied to liquid crystal is somewhat lower than that in the case where the data signal is constant.

Alternatively, the waveform A in FIG. 8A is adopted as the scanning signal, and the waveform B2 in FIG. 8B is adopted as the data signal, and the voltages $V_{sk}$, $V_{sc}$, $V_{dk}$, and $V_{dc}$ are set as follows:

$V_{sk}$=23.0 V, $V_{sc}$=−22.0 V, $V_{dk}$=3.0 V, and $V_{dc}$=0 V.

As a result, the voltages $V_{LC}$ applied to liquid crystal are obtained as follows, and the variation in display is not observed:

Voltage applied to liquid crystal (black display)

$V_{LC}$=3.1 to 3.2 V, and voltage applied to liquid crystal (white display)

$V_{LC}$=0.9 to 1.0 V.

In this case, the potential of a data signal in the regulating period $V_{dc}$=0 V, so that the amount of released charge in the case of white display is small. Accordingly, the voltage applied to liquid crystal (white display) is higher than that in the case where the waveform B1 shown in FIG. 7B is adopted.

On the other hand, if the conventional driving waveforms shown in FIGS. 12A and 12B are used as the waveforms of the scanning signal and the data signal, the voltages applied to liquid crystal are obtained as follows, and the variation in display is apparently observed:

$V_s$=24.0 V, $V_d$=3.0 V,

Voltage applied to liquid crystal (black display)

$V_{LC}$=2.8 to 3.8 V, and

Voltage applied to liquid crystal (white display)

$V_{LC}$=0.5 to 1.1 V.

As described above, in this example, the signal applied across the series circuit of the liquid crystal layer and the nonlinear resistive two-terminal device has a waveform including a regulating period as a latter half of the selection period. In the regulating period, part of charge applied to liquid crystal of picture elements in the first half of the selection period is released. As a result, the variation in voltage applied to liquid crystal due to differences in characteristics among nonlinear resistive two-terminal devices can be reduced, and the variation in display can be eliminated.

(EXAMPLE 2)

Figure 3A:
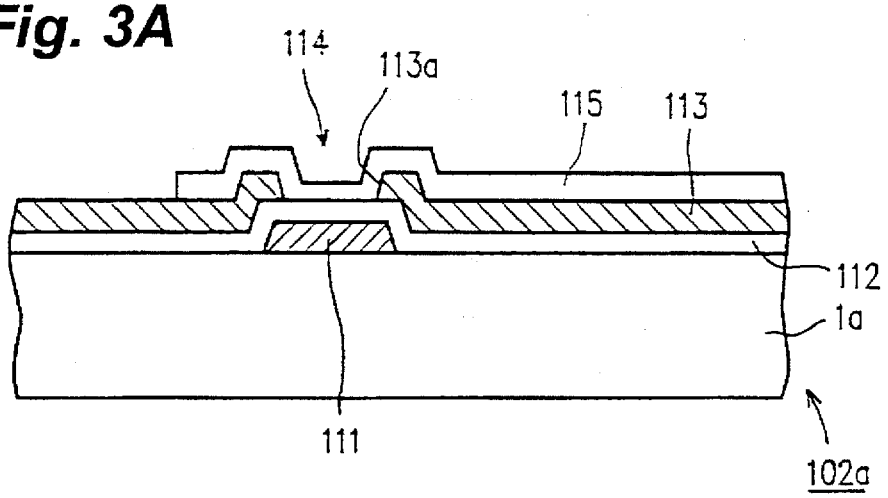
FIGS. 3A and 3B are view for illustrating a liquid crystal display apparatus using a nonlinear resistive two-terminal device in a second example according to the invention.
Figure 3B:
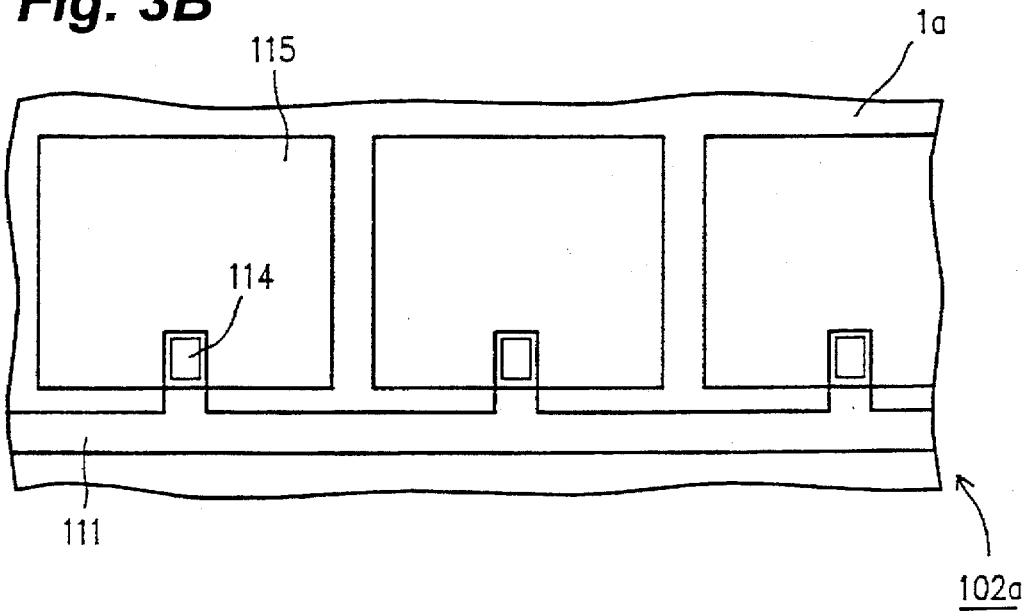

FIG. 3A is a cross-sectional view showing one of a pair of substrates which constitute a liquid crystal display apparatus in a second example according to the invention. On the substrate 102*a* shown in FIG. 3A, nonlinear two-terminal devices are formed. FIG. 3B is a plan view of the substrate 102*a* shown in FIG. 3A.

As shown in FIG. 3B, the substrate 102*a* includes a glass substrate 1*a* on which a plurality of scanning signal line 111 is formed. Along each scanning signal line 111, picture elements (pixel electrodes) 115 are arranged. Between each of the picture elements 115 and the scanning signal line 111, a nonlinear resistive two-terminal device 114 is provided. In FIG. 3A, one of a plurality of picture elements 115 is shown.

Next, a fabrication method will be described with reference to FIGS. 3A and 3B.

On the glass substrate 1*a*, a thin Ta film is formed by sputtering. The thin Ta film is patterned by photolithography, so as to form a scanning signal line 111.

Next, a thin ZnS film 112 is formed by sputtering, and then a photosensitive resin film 113 is formed. The photosensitive resin film 113 is patterned, so as to form a through hole 113*a* above the scanning signal line 111. A thin Al film is formed thereon by sputtering. The thin Al film is patterned by photolithography, so as to form pixel electrodes 115 having a shape shown in FIGS. 3A and 3B. The three-layer structure of the thin Al film 115, the thin ZnS film 112, and the thin Ta film 111 constitutes a nonlinear resistive two-terminal device 114. Thus, the formation of the counter substrate 102*a* on which nonlinear resistive two-terminal devices are formed is completed.

Figure 9B:
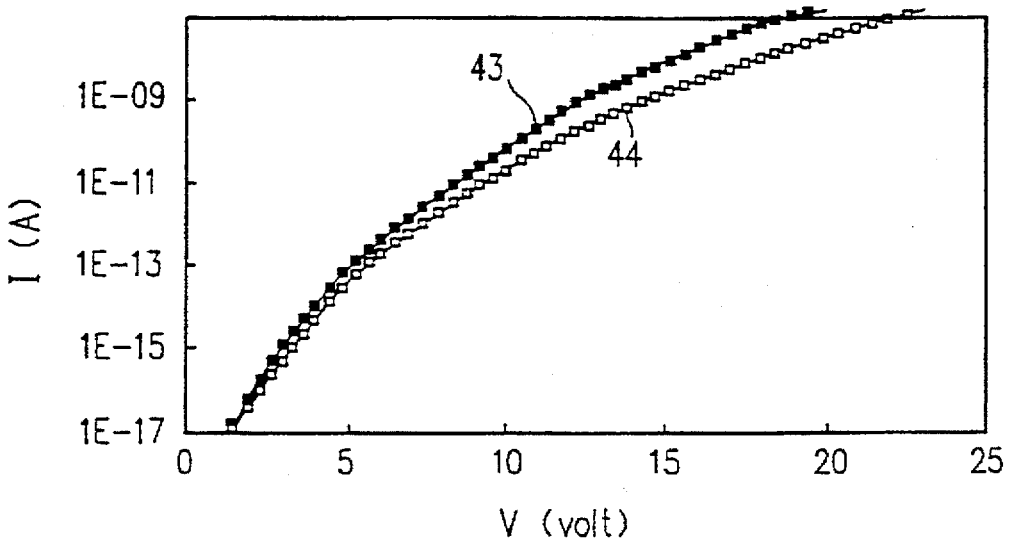
Figure 10A:
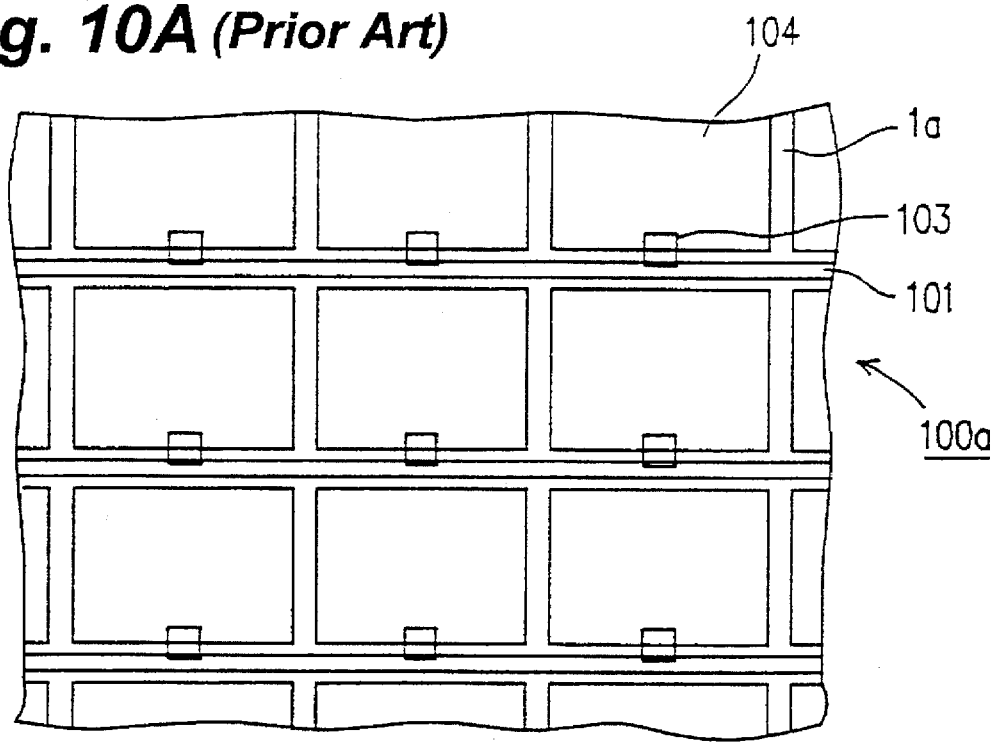
Fig. 10A (Prior Art)
FIGS. 10A and 10B are plan views of a conventional general type of liquid crystal display apparatus showing a substrate on which a nonlinear resistive two-terminal devices are formed, and a counter substrate on which the nonlinear resistive two-terminal devices are not formed, respectively.
Figure 10B:
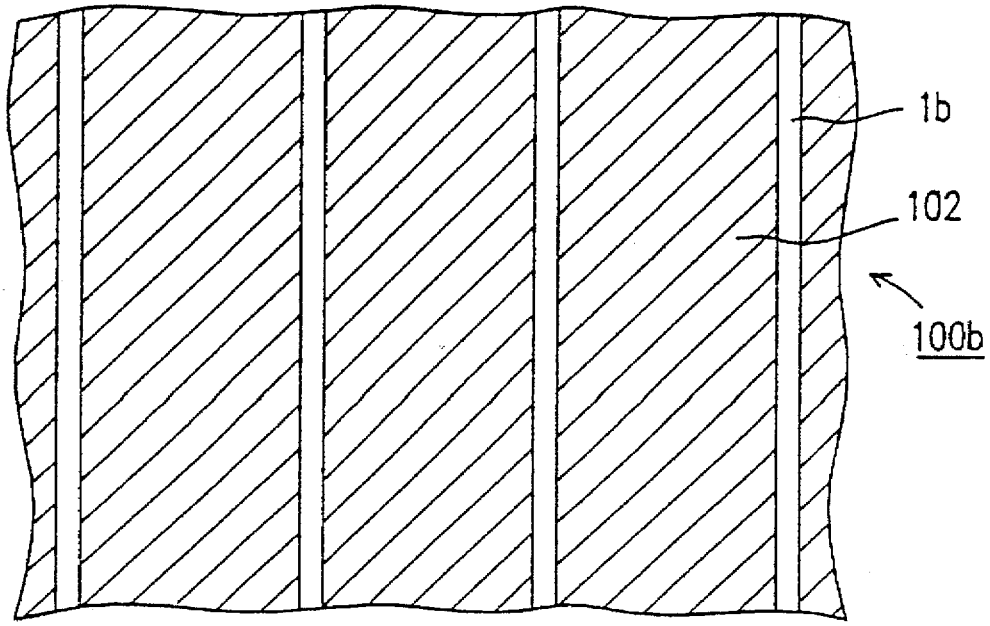
Fig. 10B (Prior Art)

The I–V characteristics may be different among the nonlinear resistive two-terminal devices 114 as shown in FIG. 9B, mainly because the thickness of the thin ZnS film formed by sputtering is not uniform. In FIG. 9B, a curve 43 represents the I–V characteristic of a device in which the ZnS film is thin, and a curve 44 represents the I–V characteristic of a device in which the ZnS film is thick.

As shown in FIG. 2, a counter substrate 101*b*, on which nonlinear resistive two-terminal devices are not formed, is fabricated in the same manner as that described in Example 1. That is, a thin ITO film is formed by sputtering on a glass substrate 1*b*. The thin ITO film is patterned by photolithography, so as to have a stripe pattern as shown in FIG. 2. Each of the strip-like thin ITO films serves as a data signal line 10.

The substrates 102*a* and 101*b* are attached to each other so that the scanning signal lines are perpendicular to the data signal lines, and then fixed by using a sealing resin. A gap between the substrates 102*a* and 101*b* is filled with liquid crystal. Thus, the formation of a liquid crystal panel is completed. Then, terminals of the scanning signal lines and terminals of the data signal lines which are led to the outside of the liquid crystal panel are connected to a scanning driver and a data driver. Thus, the formation of a liquid crystal display apparatus is completed.

Next, the functions and effects will be described.

In accordance with the method described Example 1, and in the conditions of:

Selection period of scanning signal=69.4 μsec.,

Non selection period of scanning signal=16.6 msec., $t_1$=63 μsec., and $t_2$=6.4 μsec., the voltages $V_{OPb}$, $V_{OPw}$, $V_{Rb}$, and $V_{Rw}$ are obtained as follows:

$V_{OPb}$=30 V, and $V_{Rb}$=−20 V, where the voltage $V_{LC}$ applied to liquid crystal in the case where the potential of a data signal is constant is in the range of 5.1 to 5.4 V, and $V_{OPw}$=25 V, and $V_{Rw}$=−23 V, where the voltage $V_{LC}$ applied to liquid crystal in the case where the potential of a data signal is constant is in the range of 0.7 to 0.8 V.

From these specific values, the waveforms in FIGS. 7A to 7C are adopted, and the voltages $V_{sk}$, $V_{sc}$, $V_{dk}$, and $V_{dc}$ are set as follows:

$V_{sk}$=27.5 V, $V_{sc}$=−22.5 V, and $V_{dk}$=$V_{dc}$=2.5 V.

As a result, the voltages $V_{LC}$ applied to liquid crystal are obtained as follows, and the variation in display is not observed:

Voltage applied to liquid crystal (black display)

$V_{LC}$=5.1 to 5.4 V, and voltage applied to liquid crystal (white display)

$V_{LC}$=0.5 to 0.7 V.

In this case, the voltage applied to liquid crystal in the regulating period is $V_{sc}-V_{dc}$=−25.0 V, of which the absolute value is larger than that in the case of $V_{Rw}$=−23.0 V. This means that the amount of released charge is large in the white display. Accordingly, the voltage applied to liquid crystal (white display) is somewhat lower than that in the case where the voltage applied to liquid crystal in the regulating period is set to be $V_{Rw}$=−23.0 V.

Alternatively, the waveforms in FIGS. 8A to 8C are adopted, and the voltages $V_{sk}$, $V_{sc}$, $V_{dk}$, and $V_{dc}$ are set as follows:

$V_{sk}$=27.5 V, $V_{sc}$=−20.0 V, $V_{dk}$=2.5 V, and $V_{dc}$=0 V.

As a result, the voltages $V_{LC}$ applied to liquid crystal are obtained as follows, and the variation in display is not observed:

Voltage applied to liquid crystal (black display)

$V_{LC}$=5.1 to 5.4 V, and voltage applied to liquid crystal (white display)

$V_{LC}$=−0.8 to 1.0 V.

In this case, the potential of a data signal in the regulating period $V_{dc}$=0 V, so that the amount of released charge in the case of white display is small. Accordingly, the voltage applied to liquid crystal (white display) is higher than that in the case where the waveform B1 shown in FIG. 7B is adopted.

On the other hand, if the conventional driving waveforms shown in FIGS. 12A and 12B are used, the voltages applied to liquid crystal are obtained as follows, and the variation in display is apparently observed:

$V_s$=29.0 V, $V_d$=2.5 V,

Voltage applied to liquid crystal (black display)

$V_{LC}$=4.4 to 6.3 V, and

Voltage applied to liquid crystal (white display)

$V_{LC}$=0.5 to 1.8 V.

As described above in this example, the signal applied across the series circuit consisting of the liquid crystal layer and the nonlinear resistive two-terminal device has a waveform including a regulating period as a latter half of the selection period. In the regulating period, part of the charge applied to liquid crystal of picture elements in the first half of the selection period is released. As a result, the variation in voltage applied to liquid crystal due to differences in characteristics among nonlinear resistive two-terminal devices can be reduced, and the variation in display can be eliminated.

As described, according to the liquid crystal display apparatus of this invention, the voltage of the signal applied across the series circuit of the liquid crystal layer and the nonlinear resistive device is set to be a voltage determined in accordance with video data in the writing period as a first half of a selection period; and a voltage, at which part of charge charged in the liquid crystal of picture elements in the writing period, in the regulating period as a latter half of the selection period. Accordingly, the difference in voltage applied to liquid crystal due to the variation in characteristics of nonlinear resistive two-terminal devices can be reduced, and moreover, the variation in display can be eliminated.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. A liquid crystal display apparatus comprising:

a pair of substrates and a liquid crystal layer sandwiched therebetween;

a plurality of scanning lines arranged parallel to each other, the scanning signal lines being formed on one of the pair of substrates;

a plurality of data signal lines arranged parallel to each other, the data signal lines being formed on the other of the pair of substrates;

a plurality of pixel electrodes formed on the one of the pair of substrates corresponding to portions in which the scanning signal lines cross the data signal lines, wherein the pixel electrodes, the data signal lines opposed to the pixel electrodes and portions of the liquid crystal layer between the pixel electrodes and the data signal lines constitute picture elements; and a nonlinear resistive two-terminal device provided between at least one of the pixel electrodes and scanning signal lines, wherein scanning signals each including a selection period and a non-selection period are applied to the scanning signal lines, data signals are applied to the data signal lines, wherein said scanning signals and said data signals cause liquid crystal application signals to be applied across the liquid crystal layer and the nonlinear resistive two-terminal device, wherein each of the liquid crystal application signals has a first voltage in a writing period as a first portion of the selection period and a second voltage in a regulating period as a latter portion of the selection period, the first voltage being a voltage determined in accordance with video data so that electric charge corresponding to the first voltage of the each of the liquid crystal application signals is charged into a corresponding one of the portions of the liquid crystal layer in the writing period, and the second voltage being only a single pulse of voltage, wherein a voltage level of said single pulse remains substantially constant during said regulating period and at least one of said second voltage and said regulating period is selected to provide substantially uniform charge associated with each picture element across which said liquid crystal application signal is applied and to release part of the electric charge in the corresponding one of the portions of the liquid crystal layer, and wherein at least one of said second voltage and said regulating period of each picture element is selected according to an electrical characteristic of the corresponding nonlinear resistive two-terminal device so that a difference in said electrical characteristic of each said two terminal device from a corresponding electrical characteristic of each of said other two terminal devices is substantially compensated for so that the effect of said electrical characteristic difference on said electric charge in the corresponding one of the portions of the liquid crystal layer is reduced.

2. A liquid crystal display apparatus according to claim 1, wherein each of the liquid crystal application signals has a third voltage in the non-selection period immediately after the selection period, each of the scanning signals has a potential with the same polarity as that of the third voltage in the writing period, and a potential with an opposite polarity to that of the third voltage in the regulating period, and each of the data signals has a fixed voltage determined in accordance with the video data over a whole of the selection period.

3. A liquid crystal display apparatus according to claim 1, wherein each of the liquid crystal application signals has a third voltage in the non-selection period immediately after the selection period, each of the scanning signals has a potential with the same polarity as that of the third voltage in the writing period, and a potential with an opposite polarity to that of the third voltage in the regulating period, and each of the data signals has a voltage determined in accordance with the video data in the writing period, and has a fixed voltage irrespective of the video data in the regulating period.

4. A liquid crystal display apparatus according to claim 1, wherein, in each of the scanning signals, the writing period is longer than the regulating period.

* * * * *